United States Patent [19]

Minami et al.

[11] 4,238,043

[45] Dec. 9, 1980

[54] X-RAY IMAGE INTENSIFIER

[75] Inventors: Hiroshi Minami; Takashi Kuze, both of Yokohama; Norio Harao, Ayase, all of Japan

[73] Assignee: Tokyo Shibaura Electric Co., Ltd., Kawasaki, Japan

[21] Appl. No.: 797,734

[22] Filed: May 17, 1977

[30] Foreign Application Priority Data

May 17, 1976 [JP] Japan ..... 51-55297

[51] Int. Cl.[3] ..... H01J 35/16; H01J 35/18; H01J 61/36

[52] U.S. Cl. ..... 220/2.1 R; 220/2.3 R; 228/263 A; 228/263 B; 228/263 F; 313/102; 403/271; 428/641; 428/646

[58] Field of Search ..... 220/2.2, 2.3 R, 2.1 R; 250/213 VT; 313/59, 102; 403/28, 29, 30, 270, 271, 272; 228/122, 123, 121, 263, 263 A, 263 B, 263 F; 174/50.5, 50.61, 50.63; 428/641, 646

[56] References Cited

U.S. PATENT DOCUMENTS

| | | | |
|---|---|---|---|
| 440,952 | 11/1890 | Land | 428/646 |
| 2,446,277 | 8/1948 | Gordon | 403/28 X |
| 2,596,758 | 5/1952 | Briggs, Jr. | 403/30 |
| 2,604,229 | 7/1952 | Schwarz | 403/28 X |
| 2,955,219 | 10/1960 | Niklas | 220/21 R X |
| 2,990,502 | 6/1961 | Willemse et al. | 428/641 X |
| 3,036,674 | 5/1962 | Branin | 403/270 |
| 3,061,664 | 10/1962 | Kegg | 220/2.1 R |
| 3,128,545 | 4/1964 | Cooper | 228/121 |
| 3,226,822 | 1/1966 | Budde et al. | 228/122 |
| 3,243,072 | 3/1966 | Day | 220/2.3 |
| 3,273,979 | 9/1966 | Budnick | 228/122 X |
| 3,844,026 | 10/1974 | Hutchins | 228/263 X |
| 4,019,080 | 4/1977 | Besson | 220/2.1 R X |

FOREIGN PATENT DOCUMENTS

| | | |
|---|---|---|
| 49-25810 | 7/1974 | Japan . |
| 50-14440 | 5/1975 | Japan . |

OTHER PUBLICATIONS

*Metals Handbook,* 8th Ed. vol. 8: "Metallography, Structures, and Phase Diagrams", pp. 259–269, Published by American Society for Metals, Metals Park, Ohio: 1973.

*Primary Examiner*—Allan N. Shoap
*Attorney, Agent, or Firm*—Cushman, Darby & Cushman

[57] ABSTRACT

A highly evacuated X-ray image intensifier, whose X-ray inlet window section made of aluminium or alloy thereof is hermetically fused to the output section of a glass vessel by means of a joint ring formed of glass-wettable alloy or alloy fusible with glass, wherein the X-ray inlet window section and joint ring are hermetically fused together by inserting therebetween at least one intermediate member selected from the group consisting of the following materials:

(a) tin
(b) silicon—gold
(c) silicon—tin
(d) germanium—gold
(e) germanium—tin

8 Claims, 7 Drawing Figures

X-RAY IMAGE INTENSIFIER

BACKGROUND OF THE INVENTION

This invention relates to an X-ray image intensifier, and more particularly to an X-ray image intensifier, wherein that part of the envelope which constitutes an X-ray inlet window is made of aluminium.

The X-ray image intensifier is used to convert and intensify an image provided by X-rays modulated by being penetrated through a subject into a visible image. Hitherto, the X-ray inlet window section and output section of the envelope of an X-ray image intensifier have been made of glass. Further, the X-ray inlet window is demanded to have an area conforming to the size of a subject and generally has as large a diameter as 150 to 300 mm. Since the X-ray image intensifier is highly evacuated, the glass must have a thickness of several millimeters. Accordingly, the conventional X-ray image intensifier has the drawbacks that not only the intensifier as a whole increases in weight due to inclusion of thick glass members, but also incoming X-rays are much attenuated by the thick glass of the X-ray inlet window, and considerably weakened in intensity when reaching a fluorescent layer provided inside of the X-ray inlet window section.

To eliminate the above-mentioned difficulties, an attempt has hitherto been made to reduce loss of incoming X-rays and decrease the weight of an entire X-ray image intensifier by applying an aluminum sheet in place of a glass one to the X-ray image inlet window section. In this case, it is necessary to attain high airtightness for a evacuated envelope used as an X-ray image intensifier by hermetically fusing the X-ray inlet window section with the output section of the envelope. However, aluminium and glass have different expansion coefficients and fail to be fused together. Therefore, an attempt has been made to realize the bonding of both aluminium and glass by means of a joint ring or a coupling made of glass-wettable alloy or alloy fusible with glass commercially known as "Kovar" (trademark of Westinghouse Electric Corp.) which is formed of 29% of nickel, 17% of cobalt and iron as the remainder. Yet, aluminium and Kovar cannot be directly fused together. Therefore, it was proposed, as set forth in the Japanese utility model application published before examination No. 25810/74, to meld together both aluminium and Kovar by inserting a nickel layer therebetween as an intermediate member or an interleave. Further, the Japanese utility model application published before examination No. 14440/75 disclosed application of copper as an intermediate member to attain the bonding of aluminium and Kovar. However, these proposed processes are found unacceptable for the hermetic sealing of an envelope demanded to be kept in high vacuum such as an X-ray image intensifier.

SUMMARY OF THE INVENTION

It is accordingly the object of this invention to provide an X-ray image intensifier in which the X-ray inlet window section made of aluminium or alloy thereof is tightly and hermetically bonded to a joint ring made of glass-wettable alloy or alloy fusible with glass.

The X-ray image intensifier of this invention comprises an X-ray inlet window section made of aluminium or alloy thereof, a glass envelope mainly constituting an output section and a joint ring formed of glass-wettable alloy and fused to the glass envelope. The X-ray inlet window section is hermetically fused to the joint ring with a sealing material or an intermediate member interlaminated therebetween. The sealing material should have such a property as prevents the formation of an intermetallic compound with any of the metals constituting the X-ray inlet window section and joint ring. For the object of the invention, said interlaminated or interleaved sealing material is chosen to be one selected from the group consisting of the following materials:

(a) tin
(b) silicon—gold
(c) silicon—tin
(d) germanium—gold
(e) germanium—tin

The sealing material may be interlaminated between the X-ray inlet window section and joint ring in the form of a film before being fused thereto. Gold or tin should preferably be plated on the faying surface of a joint ring before said joint ring is fused to the X-ray inlet window section. Silicon or germanium should preferably be applied to the facing surface of the X-ray inlet window section in the form of powder before said window section is fused to the joint ring. The assembled mass should be heated to higher temperature than the eutectic point of a silicon-aluminium or germanium-aluminium system. Fusion of the X-ray inlet window section and joint ring is effected by application of heat or rubbing together with heating after any of the above-elisted sealing intermediate member is inserted.

DESCRIPTION OF THE PREFERRED EMBODIMENTS

Figure 1:
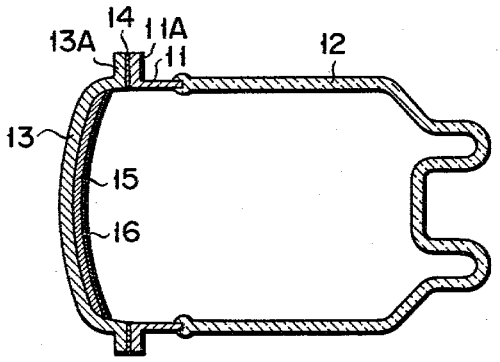
FIG. 1 is a sectional view of an envelope according to one embodiment of this invention used with an X-ray image intensifier.
Figure 2:
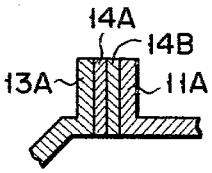
FIG. 2 is an enlarged view of the main part of the envelope of FIG. 1.
Figure 3:
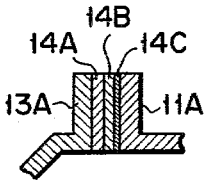
FIGS. 3 to 5 are enlarged sectional views of the main part of an envelope according to other embodiments of the invention.

There will now be described by reference to the appended drawings envelopes according to the preferred embodiments of this invention which are used with an X-ray image intensifier. Reference is first made to an X-ray image intensifier whose X-ray inlet window section and sealing joint ring are hermetically fused together with tin inserted therebetween as an intermediate member. FIG. 1 is a schematic sectional view of an envelope embodying this invention which is used with an X-ray image intensifier. A sealing joint ring 11 is made of Kovar. One side of the joint ring 11 is sealed into the terminal section of a glass envelope 12 mainly constituting the output section of an X-ray image intensifier. An X-ray input window section 13 made of aluminium takes a spherical form expanding toward the outside, namely, a convex sectional form. The inner wall of the window section 13 is provided with a fluorescent layer for converting X-rays into light and a photoelectric layer 16 for converting light into electrons. The X-ray inlet window section 13 may take a sectional form depressed toward the interior of the X-ray image intensifier, namely, a concave sectional form. The aluminium flange 13A of the X-ray inlet window section 13 is pressed against the flange 11A of the joint ring 11 with an intermediate member 14 of tin inserted therebetween. Actually, the envelope of the X-ray image intensifier contains a focusing electrode, anode, and output screen. However, these members are omitted from FIG. 1. FIG. 2 is an enlarged view of the joint of both flanges 11A, 13A. Referential numeral 14B denotes a tin layer mounted on the faying surface of the flange 11A of the joint ring 11. With this embodiment, the tin layer 14B was plated on the faying surface of the flange 11A with a thickness of 0.2 mm. However, this thickness bears no important relation to the mechanical strength of the whole fused assembly. Both flanges 11A, 13A are tightly pressed against each other with a thin tin foil 14A having a thickness of, for example, about 0.2 mm interlaminated therebetween and are fused together by being heated several minutes at a temperature of 300° to 400° C. The eutectic point of aluminium and tin is 228.3° C. and the melting point of tin is 232° C. Therefore, a higher temperature than these temperature levels enables the aluminium flange 13A of the X-ray inlet window section and the thin tin foil 14A are easily fused together due to the eutectic structure of an aluminium-tin system. The tin layer 14B plated on the faying surface of the flange 11A of the joint ring 11 is of the same metal as the tin foil 14A and can be readily bonded to said tin foil 14A. Both flanges 11A, 13A are tightly joined together by the mutual fusion of said interlaminated tin foil 14A and tin layer 14B. Therefore the X-ray inlet window section is hermetically joined with the glass vessel 12 by means of the joint ring 11. The aluminium and tin do not constitute an intermetallic compound, but forms an eutectic alloy, thereby admitting of the stable bonding of the assembled mass or body, which is quite favorable for the hermetic sealing of an X-ray image intensifier. It is advised, as shown in FIG. 3, to plate a copper layer 14C on the faying surface of the flange 11A of the joint ring 11, before the tin layer 14B is applied on said faying surface or to plate a nickel layer as the base layer of the copper layer 14C, because this arrangement attains the stable deposition of the tin layer 14B.

Figure 4:
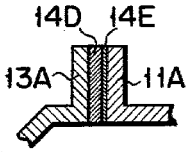

There will now be described by reference to FIG. 4 another embodiment in which the aluminium X-ray inlet window section is fused to a Kovar joint ring 11 with a silicon-gold system interlaminated therebetween. As shown in FIG. 4, silicon powder is spread over the faying surface of the flange 13A of the aluminium X-ray inlet window section to form a silicon layer 14D. The assembled mass is heated for 10 minutes at a temperature of about 600° C. slightly lower than the melting point of aluminium, thereby providing a eutectic layer of silicon and aluminium on the boundary thereof. The eutectic point of a silicon-aluminium system is 577° C. The faying surface of the flange 11A of the Kovar joint ring is coated with a gold plate 14E having a thickness of 1 to 2 microns. This plated gold layer 14E will well serve the purpose only if it has a greater thickness than 0.05 micron. Formation of this gold layer with an unnecessarily great thickness will be undesirable in respect of cost. Where the faying surfaces of both flanges 13A, 11A are heated to a temperature of about 400° C. with the silicon layer 14D and gold layer 14E pressed against each other, then the faying surfaces of the silicon layer 14D and gold layer 14E are melted into a eutectic system of silicon-gold, thereby effecting the satisfactory bonding of both flanges 11A, 13A. If rubbed with each other while being heated, both flanges 11A, 13A can be bonded more tightly. The joined portions of the flanges 11A, 13A do not give rise to the growth of an intermetallic compound, but are stably bonded together by the eutectic structures of an aluminium-silicon and a silicon-gold. Where a nickel layer is plated on the faying surface of the flange 11A of the Kovar joint ring as the base layer of the plated gold layer 14E, then said plated gold layer 14E can be securely fixed.

The foregoing embodiments refer to the case where either (a) tin or (b) a silicon-gold were interlaminated between the Kovar joint ring 11 and X-ray inlet window section 13 as sealing materials. However, it has been proved that three other sealing intermediate members such as (c) a silicon-tin, (d) a germanium-gold and (e) a germanium-tin are also useful. Like silicon, germanium should preferably be applied in the form of powder on the faying surface of the flange 13A of the X-ray inlet window section. Since the eutectic point of a germanium-aluminium is 424° C., heat treatment at a higher temperature than said eutectic point provides a eutectic layer of a germanium-aluminium. Where tin is used in place of gold, it is preferred to plate a tin layer on the faying surface of the flange 11A of the Kovar joint ring as in the case of gold. For reference, the eutectic point of a germanium-tin and that of a silicon-tin are 232° C. alike.

Figure 5:
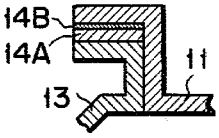
Figure 6:
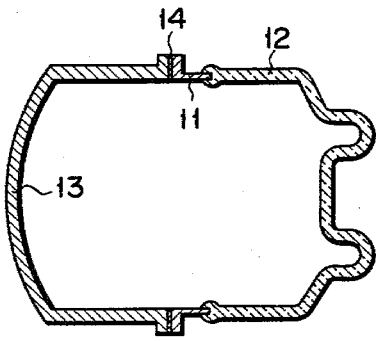
FIGS. 6 and 7 are sectional views of the envelope according to other embodiments of the invention.
Figure 7:
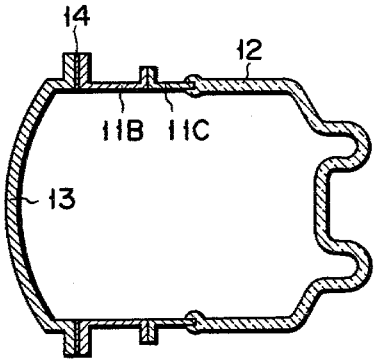

With the foregoing embodiment, the X-ray inlet window section was made of aluminium. Where, however, said window section may be of an aluminium alloy consisting of, for example, 0.5% magnesium, 1.0% of silicon, 0.3% of iron and aluminium as the remainder, then the window section itself will prominently increase in mechanical strength, thereby allowing its thickness to be decreased, and in consequence improving the X-ray permeability of said window section and rendering the resultant X-ray image intensifier more sensitive. Since the X-ray inlet window section is directly exposed to an atmosphere, it is advised to apply alumilite treatment for prevention of corrosion. Further, it is possible, as shown in FIG. 5, to bend both flanges 11A, 13A in order to save that portion of the X-ray inlet window section which is fused to the joint ring from a great mechanical stress.

Where a magnetizable member, for example, the Kovar joint ring is provided near the X-ray inlet window section, then a extraordinary disturbance would arise in an electric lens, should said Kovar joint ring be magnetized. Therefore, it is advised to cause the aluminium X-ray inlet window section 13 to constitute, as shown in FIG. 6, the considerable portion of the envelope of an X-ray image intensifier in order to keep away the joint ring 11 from the X-ray inlet window section 13. Further, the X-ray image intensifier can be easily assembled by dividing the joint ring into two components 11B, 11C, as shown in FIG. 7. In this case, the joint ring component 11B is previously pressed against the X-ray inlet window section, and the other joint ring component 11C is previously attached to the glass vessel 12. After the interior parts of the X-ray image intensifier are assembled and inserted, both joint ring components 11B, 11C are fused together. This arrangement enables the X-ray inlet window section 13 and joint ring component 11B to be easily joined together. Where the joint ring components 11B, 11C are of the same material, then they can be quickly fused together, thereby minimizing the damage of the interior parts of the X-ray image intensifier which might otherwise result from welding heat. Further, the joint ring 11B need not be made of a glass-wettable metal such as Kovar, but may be prepared from, for example, iron. Or if formed of a nonmagnetic material such as an alloy of 18 cr - 8 Ni - Fe having a magnetic permeability $\mu_m = 1.3$H/m, the joint ring 11B will not be magnetized like Kovar, favorably suppressing the disturbance of an electronic lens. Further, if prepared from soft magnetic material such as an alloy of 78 Ni - Fe, the joint ring 11B is not likely to be magnetized and is more preferred from the standpoint of shutting off an external magnetic field.

The X-ray image intensifier of this invention in which the X-ray inlet window section made of aluminium is fused to the sealing joint ring with any of the aforesaid five sealing intermediate members inserted therebetween does not give rise to the growth of an intermetallic compound, as is the case with the conventional X-ray image intensifier in which the X-ray inlet window section and that part of the glass envelope which constitutes the output section of said conventional intensifier are fused together with nickel or copper interposed therebetween. With the X-ray image intensifier of this invention, the firm and stable fusion of the X-ray inlet window section and the joint ring is effected by the eutectic structure of a two-metal system acting as a sealing intermediate member. This invention provides an X-ray image intensifier in which the X-ray inlet window section and the joint ring are bonded together in a state preferred for a highly evacuated glass envelope and whose X-ray inlet window section made of aluminium fully attains an elevated X-ray permeability.

What we claim is:

1. (Thrice Amended) An evacuated X-ray image intensifier, comprising:

an X-ray inlet window section made of aluminum or an alloy thereof;

a glass envelope mainly constituting an output section;

a joint ring prepared from a glass-wettable alloy and connected to said glass envelope; and sealing means as an intermediate member between said X-ray inlet window and said joint ring for hermetically fusing said X-ray inlet window and joint ring, said intermediate member including a first layer attached to said joint ring made of copper, a second layer attached to said inlet window and chosen from the group consisting of the following materials:

(a) tin (b) silicon, and (c) germanium, and a third layer attached to said second layer and said first layer made of tin, said intermediate member not forming an intermetallic compound with any of the materials constituting said X-ray inlet window and said joint ring.

2. The X-ring image intensifier according to claim 1, wherein the glass - wettable alloy is formed of nickel, cobalt and iron.

3. The X-ray image intensifier according to claim 1, wherein the joint ring is divided into a plurality of components.

4. The X-ray image intensifier according to claim 3, wherein at least one of the plural joint ring components is formed of a substantially nonmagnetic metal having a smaller magnetic permeability than 2 H/m and fused to the X-ray inlet window section with any of the sealing materials used as an intermediate member.

5. The X-ray image intensifier according to claim 4, wherein the metal constituting at least one of said plural joint ring components is an alloy formed of 18% of chromium, 8% of nickel and iron as the remainder.

6. The X-ray image intensifier according to claim 3, wherein at least one of the plural joint ring components is prepared from soft magnetic metal and fused to the X-ray inlet window section with any of the sealing materials used as an intermediate member.

7. The X-ray image intensifier according to claim 6, wherein the soft magnetic material is an alloy consisting of 78% of nickel and iron as the remainder.

8. The X-ray image intensifier according to claim 1, wherein the X-ray inlet window section and joint ring are fused together by means of heating and rubbing with the intermediate member inserted there between.

* * * * *